US005103603A

United States Patent [19]

Verby et al.

[11] Patent Number: 5,103,603

[45] Date of Patent: Apr. 14, 1992

[54] CONTINUOUSLY HINGED SKYLIGHT ASSEMBLY

[75] Inventors: Stanley M. Verby, Hewett Harbor; Barry Mirsky, Haupauge, both of N.Y.

[73] Assignee: Thermo-Vu Sunlite Industries, Inc., Edgewood, N.Y.

[21] Appl. No.: 526,389

[22] Filed: May 18, 1990

[51] Int. Cl.[5] ..... E04B 7/18; E04B 1/346

[52] U.S. Cl. ..... 52/72; 52/200

[58] Field of Search ..... 52/200, 72, 19; 49/397; 16/266, 355, 227

[56] References Cited

U.S. PATENT DOCUMENTS

| | | | |
|---|---|---|---|
| 1,233,960 | 7/1917 | Bernard | 52/72 |
| 2,845,665 | 8/1958 | Place | 49/397 |
| 4,570,394 | 2/1986 | Jentoft et al. | 52/72 |
| 4,750,302 | 6/1988 | Bechtold | 52/72 |

FOREIGN PATENT DOCUMENTS

| | | | |
|---|---|---|---|
| 2124689 | 2/1984 | United Kingdom | 52/72 |

*Primary Examiner*—Richard E. Chilcot, Jr.

*Assistant Examiner*—Joanne C. Downs

*Attorney, Agent, or Firm*—Darby & Darby

[57] ABSTRACT

An openable skylight assembly covers a roof opening having a raised curb around its perimeter that extends substantially perpendicularly from the roof surface. The skylight includes glazing means that substantially covers the opening. A frame assembly surrounds the glazing means, and has a depending skirt portion that opposes the outer surfaces of the curb. A hinge, joining one side of the frame to the curb so that the skylight frame may be pivoted to open the skylight, includes a generally circular bearing that is received in a cradle, which is an integral part of the frame assembly that holds the glazing means. The internal curved cradle surface has an arc exceeding 180° such that the bearing and cradle cannot be separated except when flat surfaces provided on the bearing align with the opening between the ends of the curved cradle surface. Then, by transverse motion relative to the longitudinal axis of the hinge, the frame assembly separates from the curb. No tools are required for removal and attachment of the movable skylight cover to the curb.

6 Claims, 1 Drawing Sheet

CONTINUOUSLY HINGED SKYLIGHT ASSEMBLY

FIELD OF THE INVENTION

This invention relates generally to a skylight, roof window, or hatch assembly, and the like, and more particularly concerns a construction for an operating type, that is openable, skylight or hatch assembly.

BACKGROUND OF THE INVENTION

The recent interest in contemporary architecture, particularly in connection with residential buildings, has resulted in a very substantial increase in demand for skylight assemblies, either of the fixed glazing type or of the operating or openable type. As production and installations increase in quantity, ease of manufacture, ease of installation, and cost of both manufacture and installation are important factors that must be considered in designing skylight assemblies. As with the roof itself, the leak-tight qualities of the skylight assembly are of great importance. This leakage problem is generally compounded in those skylights that open, that is, the structure including the glazing layer or layers, tilts back about a hinge on one side of the skylight. In an overall skylight construction of the openable type, the hinge or hinges can be a relatively expensive factor in overall cost. The labor in connecting the skylight hinges to the roof structure is also a factor to be considered along with the potential for leakage whenever openings are made into the basic roof structure.

Conventional leaf type hinges have been used in the prior art that are attached as independent components to the movable skylight member as well to the roof structure, with gaps between individual hinges. Assembly and disassembly of the hinge at an installation are awkward to accomplish. Specially bent hinge flanges for connection to the curb and skylight frame make the hinges relatively expensive.

What is needed is an openable skylight or hatch assembly that is economical to produce and allows for easy assembly and disassembly.

SUMMARY OF THE INVENTION

Accordingly, it is an object of this invention to provide an improved openable skylight assembly that is easily assembled or disassembled to a curb without need for tools.

Another object of this invention is to provide an improved openable skylight assembly that allows adjustment of gasket pressure and incurs little risk of leakage at the hinged joint.

Yet another object of this invention is to provide an improved openable skylight assembly that is economical to manufacture and to install.

Generally speaking, in accordance with a preferred embodiment of the invention, an openable skylight or hatch assembly is provided that has a simple construction and is economical for manufacture and installation.

An openable skylight assembly is provided in accordance with the invention for covering an opening through a surface of a structure, the opening having a raised curb around its perimeter that extends substantially perpendicularly from the roof surface. The skylight includes glazing means, for example, glass or translucent plastic that substantially covers the opening. A frame assembly surrounds the glazing means, and has a depending skirt portion that opposes the outer surfaces of the curb. A hinge joins one side of the frame to the curb so that the skylight frame may be pivoted about one edge to open the skylight. The hinge includes a generally circular bearing that is received in a cradle, which is an integral part of the frame assembly that holds the glazing means. The internal curved surface of the cradle has an arc exceeding 180° such that the bearing and cradle cannot be separated except when flat surfaces provided on the bearing align with the opening between the ends of the curved cradle surface. Then, by a transverse motion relative to the longitudinal axis of the hinge, the frame assembly with integral cradle is separable from the bearing that is attached to the curb. No tools are required for removal and attachment of the movable skylight cover to the curb.

Further objects and advantages of the invention will be apparent from the specification and drawings. The invention accordingly comprises the features of construction, combination of elements, and arrangement of parts that will be exemplified in the constructions hereinafter set forth, and the scope of the invention will be indicated in the claims.

BRIEF DESCRIPTION OF THE DRAWINGS

For a fuller understanding of the invention reference is had to the following description taken in connection with the accompanying drawings, in which.

DETAILED DESCRIPTION OF THE PREFERRED EMBODIMENTS

Figure 1:
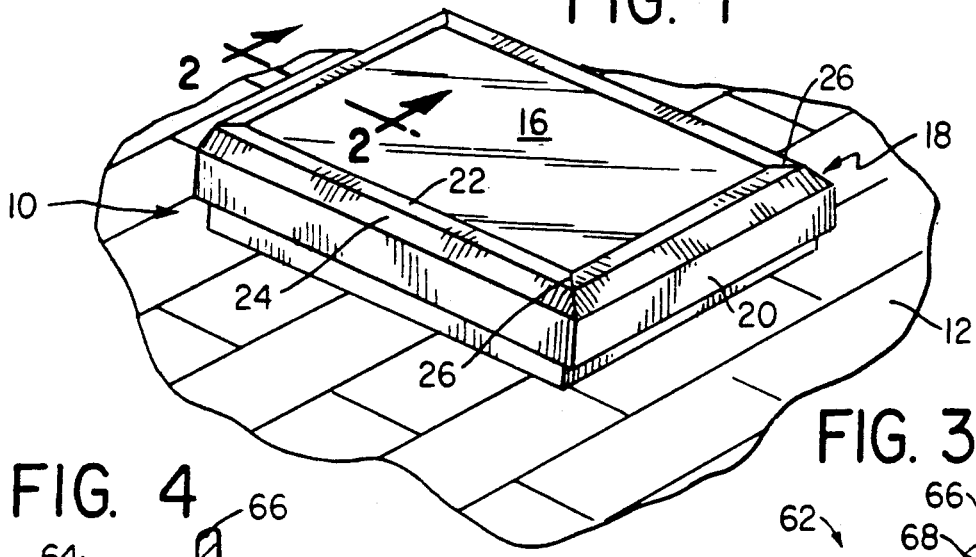
FIG. 1 is a top perspective view of a skylight or hatch assembly of the openable type in accordance with the invention, said assembly being installed on a roof.

With reference to the Figures, a skylight or hatch assembly 10 is installed on a roof 12 of a structure (not shown). The skylight assembly 10 includes a transparent or translucent glazing member formed of one sheet 16 of glass or plastic material, or in the case of a thermo-insulating arrangement, a plurality of glass or plastic sheets 16, fastened in a water-tight fashion within a frame assembly 18. The frame assembly 18 is conventional with regard to the means for retaining the glazing sheets 16 and the seals between adjoining elements.

The frame assembly 18 includes a downwardly extending skirt 20 for receiving and supporting the glazing sheets 16, and a sloped transition portion 24 between a channel 22 and the skirt 20. The frame assembly 18 is typically fabricated from extruded metal stock, such as aluminum, that is appropriately cut, with mitered joints 26 where the four side elements of the frame assembly 18 meet. The mitered corners of the frame assembly 18 are sealed, for example, by welding.

The skylight or hatch assembly 10 is supported with respect to the roof 12 on a rectangular curb 28. The curb extends perpendicularly from the surface of the roof 12 and has a rectangular opening defined between the sides of the curb 28 that corresponds dimensionally with the contours of the skylight or hatch assembly 10 so that in an assembled condition (FIG. 2), the downwardly extending skirt 20 overlaps the interface 30 between the curb 28 and the frame assembly 18.

Figure 2:
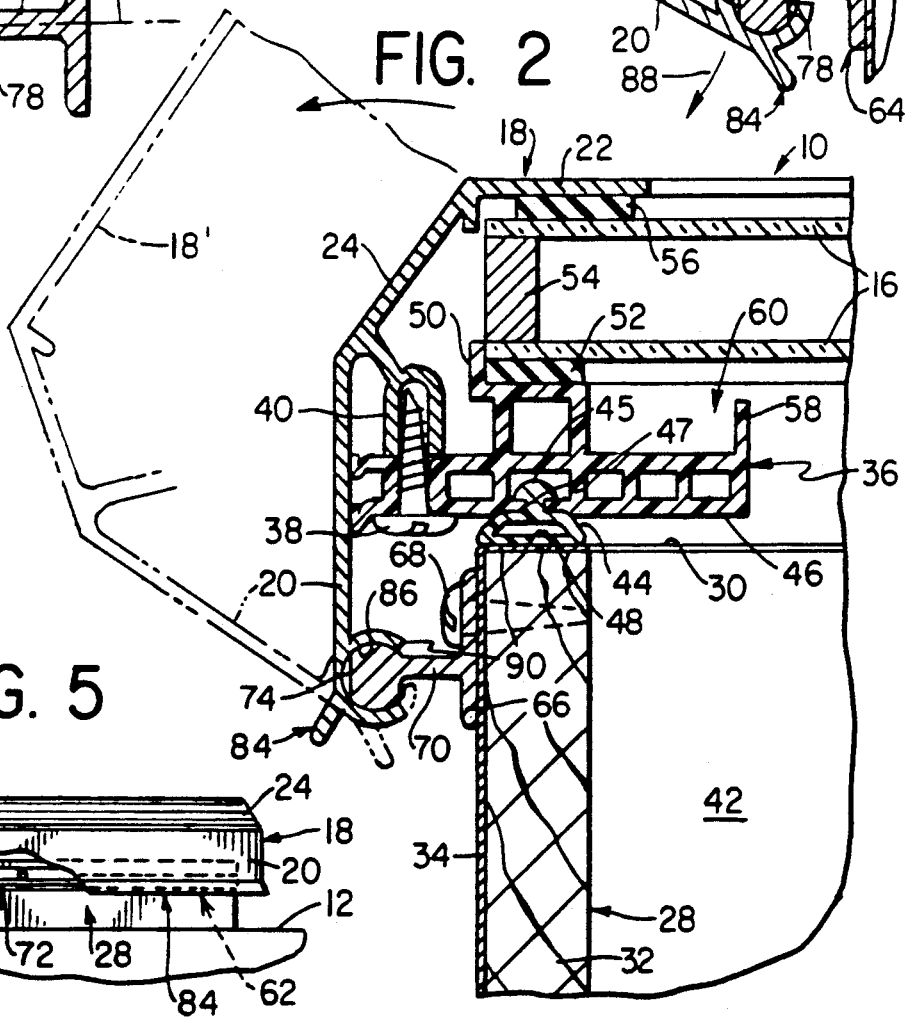
FIG. 2 is a partial sectional view, in elevation, taken along the line 2—2 of FIG. 1.

In FIG. 2, the curb 28 is a wood board 32 having a metal cladding 34 on the exterior and top surfaces thereof for protecting the wood against the weather. Other water impervious material, for example, plastic that is resistant to the elements, can be used for the cladding 34 on the curb and the wood board 32 may be replaced by plastic or metal as suits the building construction.

A plastic web 36 is fastened to the frame assembly 18 by means of a self-threading screw 38 that is received in a receptacle 40 connected to the inside surface of the sloped transition portion 24. The web 36 is generally fabricated by extrusion of plastic so that the web acts as a thermal barrier between the metal frame assembly 18, exposed to the outdoor ambient, and the interior space 42 of the structure.

A flexible hollow bulbous gasket 44 is connected to the web 36 in any suitable manner, e.g. an adhesive, and extends from the lower surface 46 of the web 36 and makes contact with the upper surface 48 of the curb 28. In FIG. 2, the gasket 44 is connected to the web 36 by means of an anchor 45 that is an integral portion of the gasket 44 and extends through a gap 47 provided through the surface 46 of the web 36. The anchor 45 may extend entirely along the gasket perimeter or occur at longitudinal intervals. Thus, a water tight seal is formed at the interface 30 between the frame assembly 18 and the curb 28. It should be understood that the web 36 and gasket 44 extend along the entire periphery of the curb 28 and, like the metal frame assembly 18, the gasket 44 and other elements of the web 36 meet with mitered corners at positions corresponding with the miters in the frame assembly 18. Thus, a continuous seal is provided for the hatch or skylight assembly 10 at the interface 30 when the frame assembly 18 is in the closed position.

The gasket 44 has greater resilience than does the web 36, which is rigid. The anchor 45 is pressed into position on the web 36 or may be slid longitudinally into place before the sides of the web 36 are joined. An adhesive may be used to supplement the anchor.

In a conventional manner, an L-shaped frame element 50 supports and constrains the lower glazing sheet 16 with a resilient seal 52 being positioned between the frame 50 and the glazing sheet 16. A spacer 54 separates the upper and lower sheets 16 in a known manner, and a second resilient seal 56 separates the upper glazing sheet 16 from the upper channel member 22 of the frame assembly 18. An inner rim 58 forms an open channel 60 wherein condensate may collect for subsequent evaporation.

It should be understood that in alternative embodiments of a skylight assembly in accordance with the invention, the gasket can be any resilient type gasket that is fastened to the underside of the web 36. The gasket may also be [a portion of] connected to the curb 28, being fixed at the top surface 48 of the curb for sealing against a continuous lower surface 46 on the web 36.

The details in construction of the web 36 and the means for holding the glazing sheets 16 to the web 36 and to the frame assembly 18 are not considered to be novel portions in this invention. Other constructions performing the same function may be utilized without affecting the scope of the invention.

A hinge assembly 62 pivotably connects the skylight frame assembly 18 to the curb 28. The hinge assembly 62 extends along one side of the curb 28 and frame assembly 18 such that the hatch assembly or skylight 10 may be pivoted about the hinge to a position of the frame assembly 18' as indicated with broken lines in FIG. 2.

The hinge assembly 62 includes a T-shaped rail 64, having a general resemblance to a conventional railroad track railing. The rail 64 includes a flat flange 66 that attaches to the curb 28 by means of screws 68 that pass through clearance openings 69 and enter into and engage the board 32 of the curb 28 from outside the interior space 42 and structure. A stem 70 extends perpendicularly from the flange 66 and terminates in a bearing 72 that is generally circular in cross section, but having a flat surface 74 substantially parallel to and spaced from the back surface 76 of the flange 66. A second flat surface 78 is formed on the bearing 72 facing the flange 66. The circular center 80 of the bearing 72 lies below the longitudinal axis 82 of the stem 70.

A cradle 84 extends inwardly from the inside surface of the downwardly extending skirt 20 of the frame assembly 18. The cradle 84 provides a curved surface 86 on which the bearing 72 may slidingly rotate. The arc of the curved surface 86 is greater than 180° but not a complete circle, such that when the hatch assembly 10 is in the closed position as indicated in FIGS. 1 and 2, the bearing 72 is secured in the cradle 84. The two elements 72,84, thus positioned, cannot be separated by a force applied in any direction transverse to the longitudinal axis of the bearing 72 and cradle 84.

Figure 3:
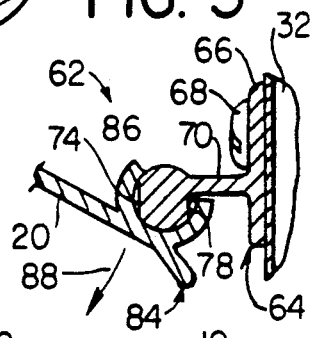
FIG. 3 is a fragmentary sectional view, in elevation, of the hinge in the skylight assembly of FIGS. 1-2, the skylight being open.
Figure 4:
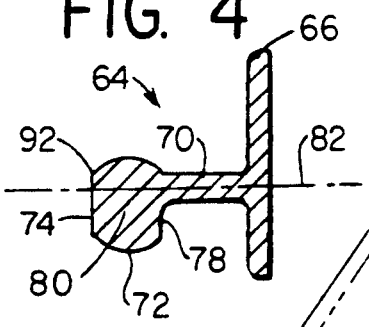
FIG. 4 is a sectional view of the hinge rail.

However, when the frame assembly 18 is pivoted on the hinge assembly 62 to a position as indicated in FIG. 3, and motion is applied to the frame assembly 18 in the direction of the arrow 88, the cradle 84 can be separated from the bearing 72. In a reverse operation, the frame assembly 18 including the glazing 16 can be snapped into position by a motion in the direction opposite to the arrow 88, without any need to longitudinally slide the bearing 72 along the full length of the cradle 84 as would be required in conventional hinges. It is not necessary to loosen the screws 68 to separate the frame assembly 18 from the curb.

This ability for the cradle 84 to separate from the bearing 72 by a transverse motion in the direction 88 is possible when the frame assembly 18 is pivoted sufficiently so that the innermost tip 90 of the cradle clears the intersection 92 between the circular cross-section and the flat outer surface 74 on the bearing 72.

Thus, the angle of the internal arc of the cradle 84, the positions of the flat surfaces 74,78 on the round surface of the bearing 72, the distance that the circular center 80 of the bearing 72 is offset from the longitudinal axis 82 of the stem 70, are among the factors determining the angle to which the frame assembly 18 must be pivoted before separation of the frame assembly 18 from the T-shaped rail 64 is possible. In summary, when the dimension of the bearing 72 in the direction transverse to the intended motional direction of the cradle 84 is less than the opening in the cradle arc, the elements can be separated.

The T-shaped rail 64 is positioned on the curb 28 at a vertical position such that the bulbous flexible gasket 44 seals against the upper curb surface 48 with the desired degree of pressure. Adjustment in gasket pressure can be effected by vertically adjusting the position of the T-shaped rail 64. This is easily accomplished when the screw openings, 69 are somewhat elongated vertical slots rather than circular holes. The hinge is concealed between the skirt and the curb and is continuous along the length of one side. Thereby, the hazards of water leakage at the hinge are minimal as the gasket 44 also provides its seal between the hinge assembly and the interior space 42. Stops, not shown, can be provided in a conventional crank mechanism (not shown) used to open a skylight of this type, or other stops can be used such that the frame assembly 18 does not inadvertently reach a tilted open position where separation of the frame assembly 18 from the curb 28 can occur upon application of a transverse force.

It should be understood that in an alternative embodiment of a hinged skylight assembly in accordance with the invention, the positions of the cradle 84 and the T-shaped rail 64 may be reversed. That is, the cradle 84 can be part of a longitudinal strip that attaches to the curb and the bearing that rides within the cradle may be connected to the depending skirt 20. Similar operation of the openable skylight assembly 10 is possible, with separation from the curb being effected at an angle determined by the contours of the cradle and bearing.

Figure 5:
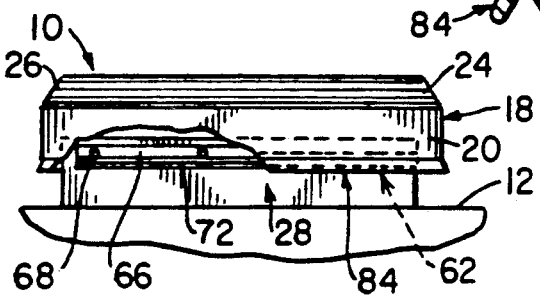
FIG. 5 is a side elevational view, partially cut away to expose the hinge, of the skylight or hatch assembly of FIG. 1.

It should also be understood that whereas a continuous hinge along the entire length of one side of the curb and skylight assembly 10 has been illustrated (FIG. 5), the hinge assembly need not be continuous.

An hinged skylight assembly 10 is thus provided that is highly functional and economical both to produce and to install.

It will thus be seen that the objects set forth above, and those made apparent from the preceding description, are efficiently attained and, since certain changes may be made in the above constructions without departing from the spirit and scope of the invention, it is intended that all matter contained in the above description and shown in the accompanying drawings shall be interpreted as illustrative and not in a limiting sense.

What is claimed:

1. An openable hatch assembly for covering an opening through a surface of a structure, said opening having a raised curb defining the perimeter of said opening, said raised curb including an external curb surface extending substantially perpendicularly away from said structure surface, said hatch assembly comprising:

covering means having a geometric shape and size suitable for substantially covering said opening;

a frame assembly surrounding the periphery of said covering means and having a depending skirt portion, said depending skirt portion opposing and being spaced from said external curb surface when said hatch assembly is joined to said raised curb;

a bearing of generally circular cross-section, said bearing being joinable to said external curb surface for location between said external curb surface and said depending skirt, said generally circular bearing cross-section including a circular portion and at least one chordal flat surface that is substantially parallel to said external curb surface when said bearing is joined to said curb surface;

a flange and stem, said bearing being connected to said flange with said stem intermediate said bearing and flange, said flange being adapted for connection to said curb, the center of said circular portion of said bearing being below the cross-sectional center of said stem;

a cradle having an arcuate surface of a radius corresponding to the radius of the circular portion of said bearing, said bearing being subject to nesting in said cradle and being rotatable within said cradle, said cradle surface having ends and extending through an arc greater than 180° and less than 360°, said cradle being joined, for alignment with said bearing, to said depending skirt portion between said skirt and said external curb surface when said latch assembly is mounted at said opening;

a distance between said ends of said arcuate cradle surface preventing separation of said bearing from said cradle when said ends are adjacent said circular portion of said bearing cross-section, the distance between said ends of said arcuate cradle surface allowing separation of said bearing from said cradle when at least one said cradle end is adjacent at least one said flat surface on said bearing.

2. An openable skylight assembly as in claim 1, wherein said cradle and skirt are integral.

3. An openable hatch assembly as in claim 1, wherein said frame assembly is pivotable relative to said curb by rotation of said cradle on said bearing, said bearing and cradle being in said relative position to prevent separation of said bearing from said cradle when said openable hatch assembly is closed.

4. An openable hatch assembly as in claim 1, wherein said frame assembly is pivotable relative to said curb by rotation of said cradle on said bearing, said bearing and said cradle being in said relative position to permit separation of said bearing from said cradle when said openable hatch assembly is pivoted relative to said curb.

5. An openable hatch assembly as in claim 1, wherein said opening is rectangular, said frame assembly having four sides dimensioned in length and width to correspond with said rectangular opening, said bearing extending along one of said sides of said rectangular opening and said frame assembly.

6. An openable hatch assembly as in claim 1, wherein said covering means includes glazing means allowing light to pass through.

* * * * *